US010773910B2

(12) United States Patent
Chiu et al.

(10) Patent No.: US 10,773,910 B2
(45) Date of Patent: Sep. 15, 2020

(54) TRAY DRAWER AND MULTI-FUNCTION PRINTER USING THE SAME

(71) Applicant: AVISION INC., Hsinchu (TW)

(72) Inventors: Chin-Chu Chiu, Hsinchu County (TW); Chi-Yao Chen, Hsinchu (TW); Ku-Ming Chen, Hsinchu County (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 15/798,853

(22) Filed: Oct. 31, 2017

(65) Prior Publication Data

US 2018/0186584 A1 Jul. 5, 2018

(30) Foreign Application Priority Data

Dec. 30, 2016 (TW) ..... 105144217 A

(51) Int. Cl.

| | |
|---|---|
| ***B65H 1/26*** | (2006.01) |
| ***B41J 13/10*** | (2006.01) |
| ***G03G 21/16*** | (2006.01) |
| ***G03G 15/00*** | (2006.01) |

(52) U.S. Cl.

CPC ..... *B65H 1/266* (2013.01); *B41J 13/10* (2013.01); *G03G 15/6502* (2013.01); *G03G 21/1695* (2013.01); *B65H 2405/121* (2013.01); *B65H 2405/325* (2013.01); *B65H 2405/35* (2013.01)

(58) Field of Classification Search

CPC ..... B65H 1/266; B65H 2405/121; B65H 2405/325; B65H 2405/35; B65H 1/027; B65H 1/04; B65H 2405/31; B65H 2405/32; B41J 13/10; G03G 21/1695

See application file for complete search history.

(56) References Cited

U.S. PATENT DOCUMENTS

| | | | | | |
|---|---|---|---|---|---|
| 5,155,537 | A * | 10/1992 | Komatsu | B65H 1/04 | 271/9.02 |
| 5,868,478 | A * | 2/1999 | Yemini | A47B 95/02 | 292/107 |
| 5,918,875 | A * | 7/1999 | Masley | B65H 1/266 | 271/145 |
| 8,136,849 | B2 * | 3/2012 | Hakemann | E05C 3/124 | 292/100 |

(Continued)

FOREIGN PATENT DOCUMENTS

| | | | |
|---|---|---|---|
| JP | 4-153130 | * | 5/1992 |
| JP | 4-164727 | * | 6/1992 |

(Continued)

OTHER PUBLICATIONS

Machine translation of JP 4-164727. (Year: 1992).*

*Primary Examiner* — Thomas A Morrison
(74) *Attorney, Agent, or Firm* — WPAT, PC

(57) ABSTRACT

A tray drawer and a multi-function printer using the same are provided. The drawer includes a tray body, a handle and an elastic element. The handle is connected to the tray body and includes a handle portion and a first engagement portion. The first engagement portion is connected to the handle portion, wherein when the tray body is at a lock state, the first engagement projects from a first position-limit portion. The elastic element connects the first engagement portion to the tray body. There is no relative motion between the first engagement portion and the handle portion.

12 Claims, 2 Drawing Sheets

(56) References Cited

U.S. PATENT DOCUMENTS

| | | | | |
|---|---|---|---|---|
| 8,870,178 | B2 * | 10/2014 | Taoka | B65H 1/00 271/145 |
| 8,944,537 | B1 * | 2/2015 | Manalang | B25H 3/028 312/319.2 |
| 10,004,331 | B2 * | 6/2018 | Jeffries | A47B 95/02 |
| 2011/0169389 | A1 * | 7/2011 | Jeffries | A47B 95/02 312/333 |
| 2011/0309730 | A1 * | 12/2011 | Retchloff | E05B 65/46 312/332.1 |

FOREIGN PATENT DOCUMENTS

| | | | |
|---|---|---|---|
| JP | 2001-206563 | * | 7/2001 |
| TW | 238947 | | 1/1995 |
| TW | M285602 | | 1/2006 |
| TW | M479064 | | 6/2014 |

* cited by examiner

TRAY DRAWER AND MULTI-FUNCTION PRINTER USING THE SAME

This application claims the benefit of Taiwan application Serial No. 105144217, filed Dec. 30, 2016, the subject matter of which is incorporated herein by reference.

BACKGROUND OF THE INVENTION

Field of the Invention

The invention relates in general to a tray drawer and a multi-function printer using the same, and more particularly to a tray drawer having a handle and a multi-function printer using the same.

Description of the Related Art

Conventional multi-function printer includes a tray drawer for carrying sheets. The multi-function printer can take the sheet within the tray drawer for transferring an image to the sheet. When the sheets within the tray drawer run out, the tray drawer may be pulled out and supplied with sheets. In general, the tray drawer is engaged with a main body of the multi-function printer by an engagement mechanism. However, space of the tray drawer is narrow or is insufficient. Thus, it results in the high difficulty in design and high cost if the engagement mechanism is too complicated.

Thus, how to design a simple engagement mechanism is one of the goals for one of ordinary skill in the art.

SUMMARY OF THE INVENTION

The present invention is to provide a tray drawer and a multi-function printer using the same capable of resolving the above problem.

An embodiment of the present invention is to provide a tray drawer. The tray drawer includes a tray body, a handle and an elastic element. The handle is connected to the tray body and includes a handle portion and a first engagement portion. The first engagement portion is connected to the handle portion, wherein when the tray body is at a lock state, the first engagement projects from a first position-limit portion. The elastic element connects the first engagement portion to the tray body. There is no relative motion between the first engagement portion and the handle portion.

An embodiment of the present invention is to provide a multi-function printer. The multi-function printer includes a tray drawer and a main body. The tray drawer includes a tray body, a handle and an elastic element. The handle is connected to the tray body and includes a handle portion and a first engagement portion. The first engagement portion is connected to the handle portion, wherein when the tray body is at a lock state, the first engagement projects from a first position-limit portion. The elastic element connects the first engagement portion to the tray body. There is no relative motion between the first engagement portion and the handle portion. The main body includes a second engagement portion. When the tray body is at the lock state, the first engagement portion and the second engagement portion are engaged with each other.

The above and other aspects of the invention will become better understood with regard to the following detailed description of the preferred but non-limiting embodiment(s). The following description is made with reference to the accompanying drawings.

DETAILED DESCRIPTION OF THE INVENTION

To make the characteristics, contents, advantages, and effects of the invention more apparent and easier to understand, the invention is disclosed with accompanying drawings, and is described by way of embodiments. A number of drawings are used in the embodiments for describing the specification. However, these drawings are schematic only, and do not necessarily reflect the actual scales and disposition relationships of the components of the implementations of the invention. Therefore, the scales and disposition relationships of the accompanying drawings should not be interpreted as actual scales and disposition relationships, and are not restrictive of actual implementations of the invention.

Advantages, characteristics and technical methods of the invention are disclosed with reference to exemplary embodiments and accompanying drawings to make the invention more apparent and easier to understand. Furthermore, the invention may be implemented in different forms, and is not limited to the embodiments disclosed below. Conversely, for anyone who is skilled in the technology field of the invention, the disclosed embodiments thoroughly and completely express the scope of the invention, and the invention will define only the appended claims.

Figure 1:
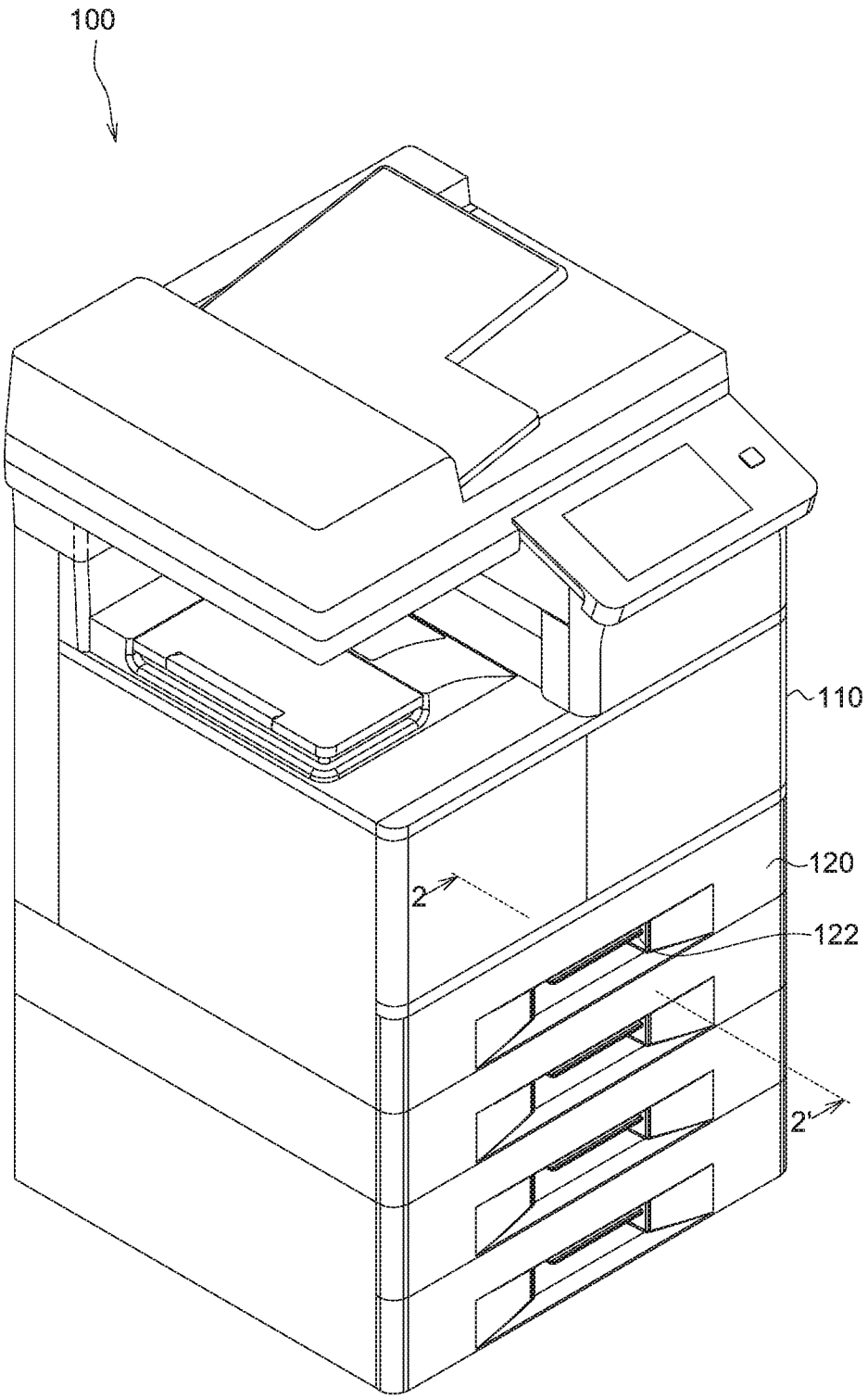
FIG. 1 is a schematic diagram of a multi-function printer according to an embodiment of the invention.
Figure 2:
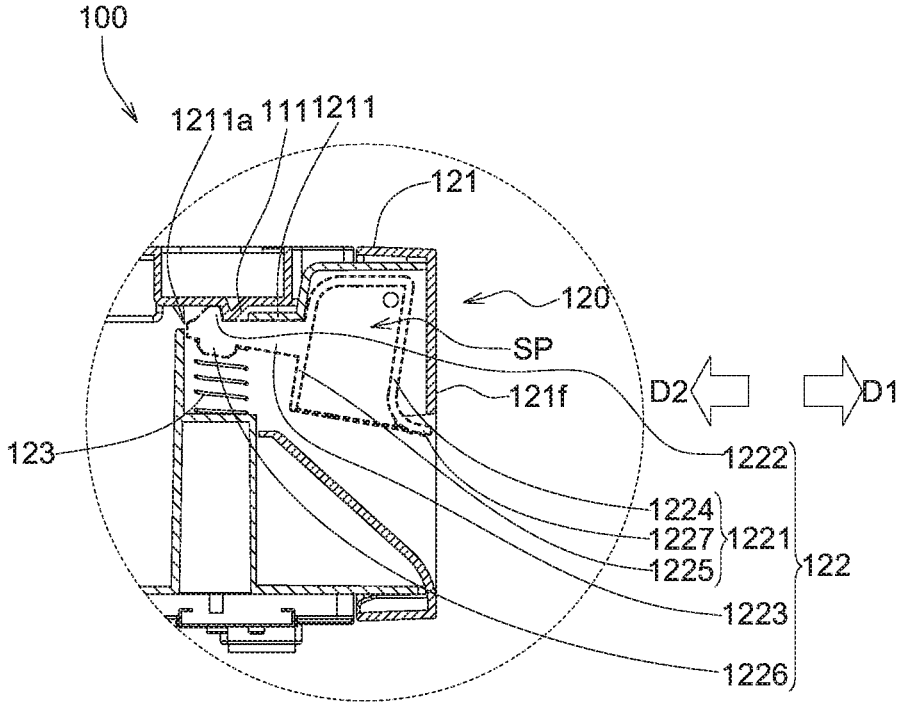
FIG. 2 is a cross-sectional view of the multi-function printer of FIG. 1 along a direction 2-2'.
Figure 3:
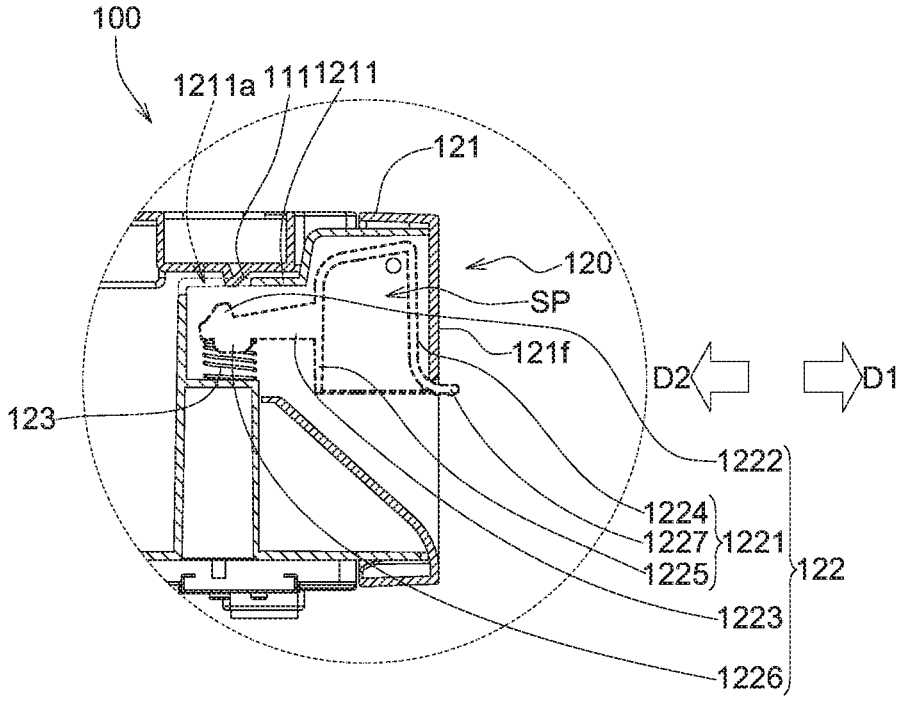
FIG. 3 is a schematic diagram of the main body and the tray drawer at an unlock state.

FIG. 1 is a schematic diagram of a multi-function printer 100 according to an embodiment of the invention, FIG. 2 is a cross-sectional view of the multi-function printer 100 of FIG. 1 along a direction 2-2', and FIG. 3 is a schematic diagram of the main body 110 and the tray drawer 120 at an unlock state.

The multi-function printer 100 has functions of the photocopying, printing, scanning, facsimile, etc. As shown in FIGS. 2 and 3, the multi-function printer 100 includes a main body 110 and at least one tray drawer 120. The tray drawer 120 is slidably connected to the main body 110 for transforming into a close state or an open state. To avoid the complicated schematic diagram, FIGS. 2 and 3 only show a portion of the main body 110 and a portion of the tray drawer 120.

As shown in FIG. 2, the tray drawer 120 and the main body 110 engage with each other to be at a lock state for preventing the tray drawer 120 from being easy to be detached from the main body 110. The main body 110 includes a second engagement portion 111. The tray drawer 120 includes a tray body 121, a handle 122 and an elastic element 123. The tray body 121 includes an upper plate 1211 having a first position-limit portion 1211*a* (broken line as shown in FIG. 3). In the present embodiment, the first position-limit portion 1211*a* is an opening, but the invention is not limited thereto. When the first position-limit portion 1211*a* is the opening, the opening substantially faces a direction vertical to the ground. The handle 122 includes a handle portion 1221, a first engagement portion 1222 and a linkage 1223, wherein the first engagement portion 1222 connects with the handle portion 1221 by the linkage 1223. When the tray body 121 is at the lock state, as shown in FIG.

2, the first engagement portion 1222 projects from the first position-limit portion 1211*a* of the tray body 121 for engaging with the second engagement portion 111 of the main body 110, such that the tray drawer 120 and the main body 110 engage with each other. As a result, it can prevent the tray drawer 120 from being easy to be detached from the main body 110. In addition, at least one portion of the second engagement portion 111 of the main body 110 also may located at the first position-limit portion 1211*a*, but the invention is not limited thereto.

As shown in FIG. 2, the upper plate 1211 has a portion adjacent to the first position-limit portion 1211*a*, and the portion may block the handle 122 from over-rotating. In other words, when the handle 122 rotates to touch the upper plate 1211, the handle 122 is blocked by the upper plate 1211. At this time, the first engagement portion 1222 of the handle 122 engages with the second engagement portion 111 of the main body 110.

In an embodiment, the first engagement portion 1222 of the handle 122 and the second engagement portion 111 of the main body 110 are both protrusions, wherein the first engagement portion 1222 and the second engagement portion 111 are staggered in an open direction D1, and the first engagement portion 1222 is more far away from the handle portion 1221 than the second engagement portion 111. As a result, as shown in FIG. 2, when the first engagement portion 1222 and the second engagement portion 111 engage with each other, the second engagement portion 111 may block the first engagement portion 1222 from moving in the open direction D1, and accordingly it can prevent the tray drawer 120 from being easy to be detached from the main body 110 in the open direction D1.

As shown in FIG. 2, the elastic element 123 connects the first engagement portion 1222 to the tray body 121. When the handle 122 rotates to make the elastic element 123 transform, as shown in FIG. 3, the elastic element 123 stores the elastic potential energy. As a result, when the handle 122 of FIG. 3 is released, the elastic element 123 releases the elastic potential energy, such that the handle 122 automatically returns back the unlock state, as shown in FIG. 2. As shown in FIG. 3, the handle 122 further includes a second position-limit portion 1226 connecting to the linkage 1223 and disposed opposite to the first engagement portion 1222. The elastic element 123 has an end surrounding the second position-limit portion 1226, such that the end may be restricted by the second position-limit portion 1226. As a result, it can prevent the elastic element 123 from being easy to be detached from the handle 122.

As shown in FIG. 2, there is no relative motion between the first engagement portion 1222 and the handle portion 1221, that is, the first engagement portion 1222 is fixed to the handle portion 1221. In the present embodiment, the first engagement portion 1222 and the handle portion 1221 are connected by the linkage 1223. The linkage 1223 extends, for example, in single straight direction, that is, the linkage 1223 is a straight bar, but the invention is not limited thereto. In addition, the linkage 1223 fixedly connects the first engagement portion 1222 to the handle portion 1221. The linkage 1223, the first engagement portion 1222 and the handle portion 1221 are integrated into one piece, and thus there is no relative motion between the first engagement portion 1222 and the handle portion 1221. In an embodiment, the linkage 1223, the first engagement portion 1222 and the handle portion 1221 may be formed by way of integrally formed manufacture process, for example, the injection molding. In another embodiment, the linkage 1223, the first engagement portion 1222 and the handle portion 1221 may individually formed and then combined together. In addition, due to the length of the linkage 1223 being short, a distance between the handle portion 1221 and the first engagement portion 1222 is also short.

In addition, the handle portion 1221 includes a front plate 1224 and a rear plate 1225. The front plate 1224 and the rear plate 1225 provide a handling space SP therebetween, and the handle 122, and accordingly it can allow hand to enter handling space SP to easily hold the front plate 1224 for operating the handle portion 1221. The linkage 1223 connects the first engagement portion 1222 to the rear plate 1225. In the present embodiment, the linkage 1223 may directly extend to the first engagement portion 1222 from the rear plate 1225 in a close direction D2 of the tray body 121. In other words, there is no other element between the rear plate 1225 and the first engagement portion 1222 except for the linkage 1223, but the invention is not limited thereto.

In addition, the handle 122 is pivotally connected to the tray body 121 for rotating with respect to the tray body 121. As shown in FIG. 3, when the tray body 12 is supplied with the sheets, the handle 122 may be operated to rotate for lifting the lock state of the tray drawer 120 and the main body 110 to be the unlock state, as shown in FIG. 3. At the unlock state, the first engagement portion 1222 of the handle 122 is detached from the first position-limit portion 1211*a* of the tray body 121 and detached from the second engagement portion 111 of the main body 110. As a result, the tray drawer 120 may be pulled out in the open direction D1 for being easy to be supplied with the sheets.

As shown in FIGS. 2 and 3, the front plate 1224 of the handle portion 1221 has a bottom end 1227 extending away from the first engagement portion 1222 or extending in the open direction D1. When the tray body 121 is at the lock state, as shown in FIG. 2, the bottom end 1227 of the front plate 1224 does not project from the front surface 121*f* of the tray body 121, and accordingly it can beautify the appearance of the multi-function printer 100 and prevent the bottom end 1227 from interfering with the component outside the multi-function printer 100. As shown in FIG. 3, when the handle portion 1221 is cocked to rotate and make the tray body 121 be the unlock state, the bottom end 1227 of the front plate 1224 projects from the front surface 121*f* of the tray body 121.

As described above, the tray drawer of the present embodiment includes the tray body, the handle and the elastic element. The handle has a small volume, and accordingly it can simplify the design of the tray drawer and reduce the manufacture cost. In an embodiment, the handle includes the handle portion and the first engagement portion, wherein there is no relative motion between the handle portion and the first engagement portion. For example, the handle portion and the first engagement portion are integrated into one piece. In another embodiment, the handle further includes the linkage, wherein the linkage fixedly connects the handle portion to the first engagement portion, and there is no relative motion among the linkage, the handle portion and the first engagement portion. For example, the linkage, the handle portion and the first engagement portion are integrated into one piece.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A tray drawer, comprising:

a tray body having an opening facing downwardly;

a handle comprises:

a handle portion having a handling space entirely located within the tray body and exposed from the opening, wherein the handle is pivotally connected to the tray body;

a first engagement portion connected to the handle portion and extending upward from a portion of the handle portion, wherein when the tray body is at a lock state, the first engagement portion projects from a first position-limit portion;

a linkage fixedly connecting the first engagement portion to the handle portion; and a second position-limit portion protrudently disposed on the linkage and opposite to the first engagement portion; and an elastic element disposed between the second position-limit portion and the tray body;

wherein there is no relative motion between the first engagement portion and the handle portion;

when the tray body is at an unlock state, the elastic element is compressed by the second position-limit portion;

wherein the handle portion comprises a rear plate and a front plate connected to and opposite to the rear plate, and the handling space is surrounded by the rear plate and the front plate;

wherein the elastic element is a coil spring, and the second position-limit portion is in direct contact with the coil spring.

2. The tray drawer according to claim 1, wherein the tray body has the first position-limit portion being an opening.

3. The tray drawer according to claim 1, wherein the tray body comprises an upper plate on which the first position-limit portion is disposed.

4. The tray drawer according to claim 1, wherein the linkage directly extends in a close direction from the rear plate of the handle portion.

5. The tray drawer according to claim 1, wherein when the tray body is at the lock state, the first engagement portion is located within the first position-limit portion.

6. The tray drawer according to claim 1, wherein the handle portion comprises the front plate, a bottom end of the front plate extends away from the first engagement portion; when the tray body is at the lock state, the bottom end of the front plate does not project from a front surface of the tray body; when the tray body is at the unlock state, the bottom end of the front plate projects from the front surface of the tray body.

7. A multi-function printer, comprising:

the tray drawer according to claim 1; and a main body comprising a second engagement portion;

wherein when the tray body is at the lock state, the first engagement portion and the second engagement portion are engaged with each other.

8. The multi-function printer according to claim 7, wherein the tray body comprises an upper plate on which the first position-limit portion is disposed.

9. The multi-function printer according to claim 7, wherein the front plate and the rear plate provide the handling space therebetween, and the linkage fixedly connects the first engagement portion to the rear plate.

10. The multi-function printer according to claim 9, wherein the linkage directly extends in a close direction from the rear plate of the handle portion.

11. The multi-function printer according to claim 7, wherein when the tray body is at the lock state, the first engagement portion is located within the first position-limit portion.

12. The multi-function printer according to claim 7, wherein the handle portion comprises the front plate, a bottom end of the front plate extends away from the first engagement portion; when the tray body is at the lock state, the bottom end of the front plate does not project from a front surface of the tray body; when the tray body is at the unlock state, the bottom end of the front plate projects from the front surface of the tray body.

* * * * *